US010070497B2

(12) United States Patent
Wang et al.

(10) Patent No.: US 10,070,497 B2
(45) Date of Patent: Sep. 4, 2018

(54) SMART LIGHTING SYSTEM AND CONTROL METHOD THEREOF

(71) Applicant: OPPLE LIGHTING CO., LTD., Shanghai (CN)

(72) Inventors: Liang Wang, Shanghai (CN); Zhixian Zhou, Shanghai (CN); Yang Hu, Shanghai (CN); Tianhang Zheng, Shanghai (CN); Jian Wang, Shanghai (CN); Wei Wen, Shanghai (CN); Jie He, Shanghai (CN); Jie Chen, Shanghai (CN); Wanghui Yan, Shanghai (CN); Juan Bian, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 15/681,054

(22) Filed: Aug. 18, 2017

(65) Prior Publication Data

US 2017/0347422 A1 Nov. 30, 2017

Related U.S. Application Data

(63) Continuation of application No. PCT/CN2016/084725, filed on Jun. 3, 2016.

(30) Foreign Application Priority Data

Jun. 8, 2015 (CN) ..... 2015 1 0307904
Jun. 8, 2015 (CN) ..... 2015 1 0313367
(Continued)

(51) Int. Cl.
*H05B 33/00* (2006.01)
*H05B 33/08* (2006.01)

(52) U.S. Cl.
CPC ..... *H05B 33/0872* (2013.01); *H05B 33/0854* (2013.01)

(58) Field of Classification Search
CPC ..... H05B 37/0272; H05B 37/0227; H05B 37/0218; H05B 37/0236; H05B 37/0281;
(Continued)

(56) References Cited

U.S. PATENT DOCUMENTS 8,415,886 B2 4/2013 Tsou
9,101,030 B2 8/2015 Shen et al.
(Continued)

FOREIGN PATENT DOCUMENTS

CN 102394040 A 3/2012
CN 102966873 A 3/2013
(Continued)

OTHER PUBLICATIONS

International Search Report (including English translation) issued in corresponding International Application No. PCT/CN2016/084725, dated Aug. 24, 2016, 8 pages.
(Continued)

*Primary Examiner* — Monica C King
(74) *Attorney, Agent, or Firm* — Arch & Lake LLP

(57) ABSTRACT

The present disclosure discloses a smart lighting system and a control method for the smart lighting system. The smart lighting system includes: an environment acquisition module being configured to acquire environment information and at least one lighting module, and where the environment acquisition module includes: a color detection unit configured to acquire color information in an environment; an auxiliary detection unit configured to acquire auxiliary information in the environment, wherein the environment information is determined by using the color information and/or the auxiliary information; an operational unit and a control
(Continued)

unit configured to determine a control signal according to the environment information; and where the at least one lighting module includes: a driving unit configured to determine a driving signal according to the control signal; and at least one light source configured to receive the driving signal and emit light according to the driving signal.

20 Claims, 9 Drawing Sheets

(30) Foreign Application Priority Data

Jun. 8, 2015 (CN) ..... 2015 2 0387241 U
Jun. 8, 2015 (CN) ..... 2015 2 0394490 U

(58) Field of Classification Search
CPC ..... H05B 33/08; H05B 33/0842; H05B 33/0854; H05B 33/0872; H05B 37/0245
See application file for complete search history.

(56) References Cited

U.S. PATENT DOCUMENTS

| | | | | |
|---|---|---|---|---|
| 2010/0320917 | A1 | 12/2010 | Tsou | |
| 2014/0084165 | A1* | 3/2014 | Fadell ..... | G08B 17/00 250/340 |
| 2014/0267470 | A1 | 9/2014 | Kang | |
| 2014/0285114 | A1 | 9/2014 | Shen et al. | |

FOREIGN PATENT DOCUMENTS

| | | | |
|---|---|---|---|
| CN | 103228078 | A | 7/2013 |
| CN | 104540264 | A | 4/2015 |
| CN | 105101536 | A | 11/2015 |
| CN | 204810605 | U | 11/2015 |

OTHER PUBLICATIONS

Written Opinion issued in corresponding International Application No. PCT/CN2016/084725, dated Aug. 24, 2016, 5 pages.

* cited by examiner

SMART LIGHTING SYSTEM AND CONTROL METHOD THEREOF

CROSS-REFERENCE TO RELATED APPLICATIONS

This application is based upon and claims the priority of PCT patent application No. PCT/CN2016/084725 filed on Jun. 3, 2016 which claims the priority of Chinese Patent Application No. 201510313367.3 filed on Jun. 8, 2015, Chinese Patent Application No. 201520394490.8 filed on Jun. 8, 2015, Chinese Patent Application No. 201510307904.3 filed on Jun. 8, 2015 and Chinese Patent Application No. 201520387241.6 filed on Jun. 8, 2015, the entire contents of all of which are hereby incorporated by reference herein for all purposes.

TECHNICAL FIELD

The present disclosure relates to the technical field of lighting, in particular relates to a smart lighting system and a control method thereof.

BACKGROUND

With the development of the lighting technology, a wide variety of light sources become available. These light sources may be TL lamps, halogen lamps, light-emitting diodes (LEDs) and other light sources.

Also, people's requirements on lighting become higher and higher. An intensity or a color variation of light emitted by a light source may be adjusted by manually turning on a mechanical switch. However, the way of adjustment by mechanical switches may not only require a manual operation but also may have poor adjustability and cannot obtain an optimum illuminating effect.

SUMMARY

The present disclosure provides a smart lighting system and a control method thereof that are used for detecting various types of information in the environment and controlling a color of emitted light according to the detected information.

The present disclosure provides a smart lighting system. The smart lighting system may include an environment acquisition module being configured to acquire environment information and at least one lighting module, and where the environment acquisition module may include: a color detection unit configured to acquire color information in an environment; an auxiliary detection unit configured to acquire auxiliary information in the environment, where the environment information may be determined by using the color information and/or the auxiliary information; an operational unit and a control unit configured to determine a control signal according to the environment information; and where the at least one lighting module may include: a driving unit configured to determine a driving signal according to the control signal; and at least one light source configured to receive the driving signal and emit light according to the driving signal.

The present disclosure also provides a control method for a smart lighting system including an environment acquisition module being configured to acquire environment information and at least one lighting module. The control method may include: allowing a color detection unit to acquire color information in an environment; allowing an auxiliary detection unit to acquire auxiliary information in the environment; determining the environment information according to the color information and the auxiliary information; allowing an operational unit and a control unit to determine a control signal according to the environment information; allowing a driving unit to determine a driving signal according to the control signal; and allowing a light source to emit light according to the driving signal.

It should be understood that both the foregoing general description and the following detailed description are only exemplary and explanatory and are not restrictive of the disclosure.

BRIEF DESCRIPTION OF THE DRAWINGS

The accompanying drawings described here are only used for further understanding of the present disclosure and are one part of the present disclosure. The preferred embodiments of the present disclosure and the description thereof are used for illustrating the present disclosure and not intended to limit the present disclosure in an inappropriate way. In the drawings.

Figure 1:
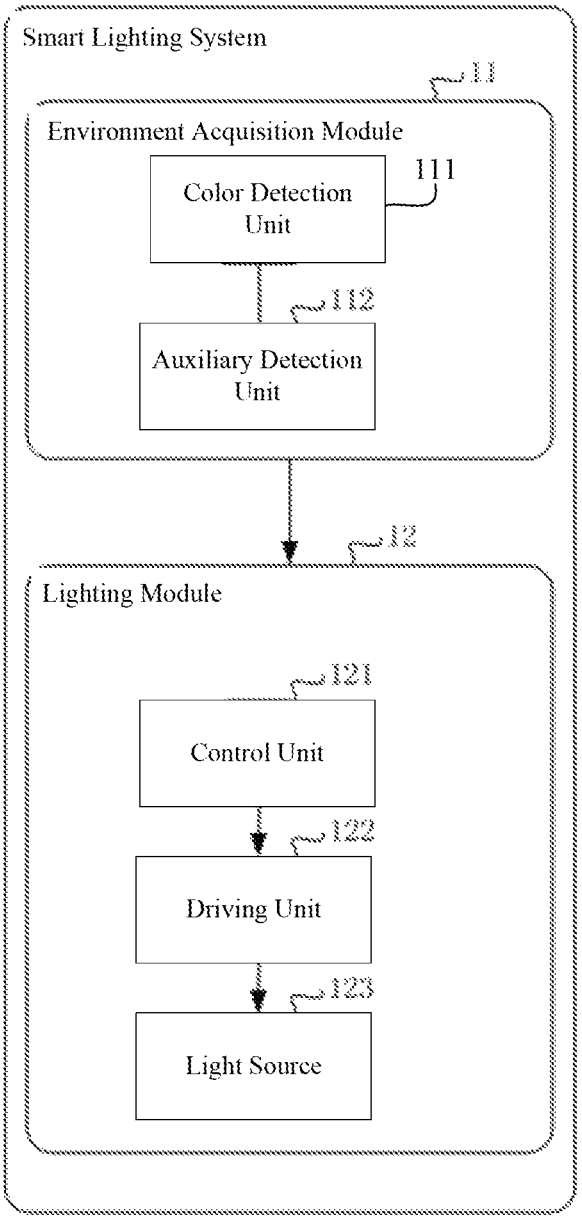
FIG. 1 is a schematic architecture diagram of a smart lighting system provided by a first embodiment of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

In order to illustrate purposes, technical solutions and advantages of the present disclosure more clearly, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. Based on embodiments of the present disclosure, all other embodiments obtained by those skilled in the art without making other inventive work should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

With the further development of the lighting technology, a smart lighting system emerges. The smart lighting system may include a color detection unit, a driving unit and a light source. The color detection unit may be configured to acquire color information of an irradiated operating surface, and the irradiated operating surface may refer to a surface of an irradiated object. The driving unit may be configured to determine a driving signal according to the color information. The light source may be configured to receive the driving signal and emit light according to the driving signal.

However, sometime, a smart lighting system can only detect the color information of the irradiated operating surface and adjust the color of the light emitted by the light source according to the color information, but does not detect other information in the environment and control the color of the emitted light according to various types of the detected information. The present disclosure provides examples that may resolve this issue.

Compared with other examples, the embodiments of the present disclosure have the following advantages: in the embodiments of the present disclosure, an auxiliary detection unit is additionally arranged to detect various types of information in the environment and the color of the emitted light is controlled according to the detected information. In addition, the present disclosure selects a corresponding lighting output mode according to a position of a point that represents a target light color in the CIE 1931 chromatic diagram, obtains control signals for controlling luminescent units according to the lighting output mode, and hence can achieve an optimal ultimate illuminating effect.

Detailed description will be given below to the technical solutions of various embodiments of the present disclosure with reference to the accompanying drawings.

FIG. 1 is a schematic architecture diagram of a smart lighting system provided by a first embodiment of the present disclosure.

Figure 2:
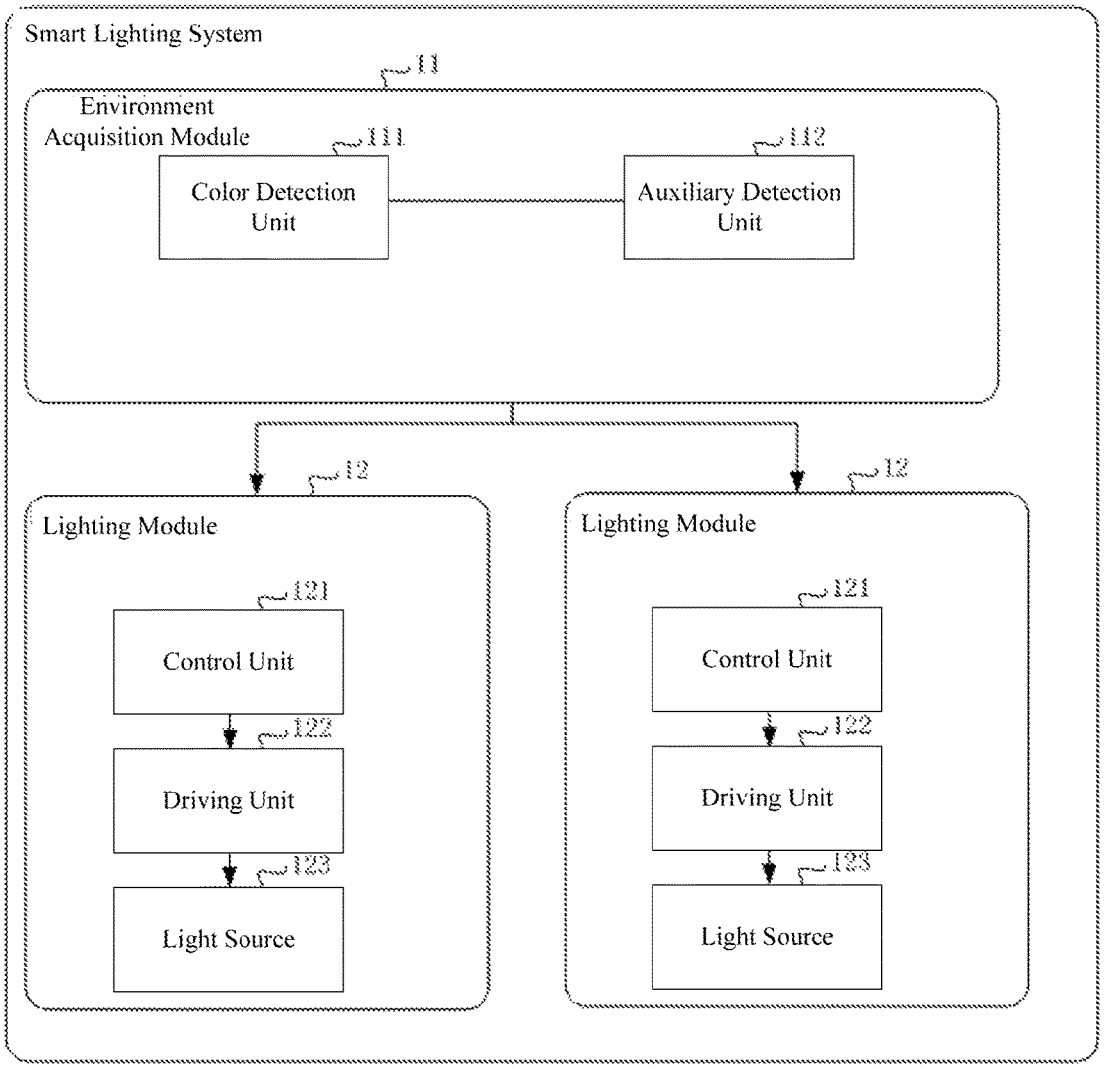
FIG. 2 is another schematic architecture diagram of the smart lighting system provided by the first embodiment of the present disclosure.

FIG. 2 is another schematic architecture diagram of the smart lighting system provided by the first embodiment of the present disclosure.

As illustrated in FIG. 1, the smart lighting system provided by the first embodiment of the present disclosure may include an environment acquisition module 11 configured to acquire environment information and at least one lighting module 12 used for illumination.

More specifically, the environment acquisition module 11 may include a color detection unit 111 and an auxiliary detection unit 112.

The color detection unit 111 may be configured to acquire color information in the environment and may be a color sensor or a spectrometer detector. The color information includes relative intensities of RGB components, namely chromaticity coordinate points of colors. The RGB color mode is a color standard in the industry, in which a variety of colors are obtained by the variations of channels of RGB three colors and a mutual superimposition of the channels, and R, G and B represent the colors of the RGB three channels. In a specific application, the color detection unit 111 may be close to or fixed on an irradiated operating surface, so as to achieve the effect of accurately acquiring the color information.

The auxiliary detection unit 112 may be configured to acquire auxiliary information in the environment. The auxiliary information includes information about whether there is a human body in a space provided with the smart lighting system, air quality information, and information about a specific position of the human body, etc. The auxiliary detection unit 112 includes a variety of sensors for detecting the auxiliary information in the environment and may include at least one of a human body detecting sensor, an air quality sensor or a position sensor. The environment information is determined by the color information and/or the auxiliary information. In the embodiments of the present disclosure, the auxiliary detection unit is additionally arranged to detect various types of information in the environment and control the color of emitted light according to the detected information.

More specifically, the lighting module 12 may include an operational unit (not shown in the figure), a control unit 121, a driving unit 122 and at least one light source 123, wherein the operational unit may also be included in the environment acquisition module 11.

The control unit 121 and the operational unit are configured to determine a control signal according to the environment information provided by the environment acquisition module 11.

The driving unit 122 may be configured to determine a driving signal according to the control signal. The driving signal may include a modulation signal in different manners. In embodiments of the present disclosure, the modulation signal is a pulse width modulation (PWM) signal.

The at least one light source 123 may be configured to receive the driving signal and emit light according to the driving signal. The light source 123 may be an LED light source and may also be a TL lamp, or a halogen lamp, etc. When the light source 123 is an LED light source, the driving signal received by the LED light source includes a PWM signal in an RGBW four-channel LED. R refers to red; G refers to green; B refers to blue; and W refers to white. The color outputted by the smart lighting system may be generated by synthesis of RGB three colors according to different proportions.

It should be noted that a positional relationship between the environment acquisition module 11 and the lighting module 12 in the smart lighting system may at least include the following cases:

The environment acquisition module 11 and the lighting module 12 may be integrally arranged, namely integrated into an object, e.g., a lamp of the smart lighting system.

The color detection unit 111 is separately arranged with the lighting module 12 and also separately arranged with the auxiliary detection unit 112. The lighting module 12 may be integrally arranged with the auxiliary detection unit 112. For instance, the color detection unit 111 is disposed on the irradiated operating surface, and the lighting module 12 and the auxiliary detection unit 112 are integrated onto the lamp of the smart lighting system.

The color detection unit 111 is separately arranged with the lighting module 12 and also separately arranged with the auxiliary detection unit 112. The lighting module 12 is separately arranged with the auxiliary detection unit 112. For instance, the color detection unit 111 is disposed on the irradiated operating surface; the lighting module 12 is disposed on the lamp of the smart lighting system; and the auxiliary detection unit 112 is disposed on a smart device capable of controlling the smart lighting system remotely, e.g., a smart mobile phone or a smart bracelet. In this case, the auxiliary detection unit 112 may communicate with other units (e.g., the color detection unit 111) in the environment acquisition module 11 and/or the lighting module 12 through a program interface using a wired or wireless approach.

The environment acquisition module 11 may communicate with the lighting module 12 by a wired or wireless approach. The wired approach may adopt a telephone line, a network cable, or a universal series bus (USB), etc. The wireless approach may adopt Bluetooth, WIFI, or ZigBee, etc.

The smart lighting system controls and drives the lighting module 12 to emit light according to the environment information acquired by the environment acquisition module 11. The smart lighting system may have a variety of light-emitting modes. The multiple light-emitting modes may be randomly selected through physical buttons or a smart device (e.g., a mobile terminal such as a smart bracelet and a smart mobile phone) capable of communicating with the smart lighting system by the wired or wireless approach.

A light-emitting mode may be as follows:

firstly, allowing a human body detecting sensor to determine whether there is a human body;

if so, turning on illumination to emit white light;

if not, not turning on illumination;

then, allowing an air quality sensor to detect the air quality of the environment;

if the air quality is poor (a certain parameter is lower than a default value), adjusting the light source to emit red light (the color of the light may be set according to the user's preferences) to prompt the user of poor air quality, wherein in an actual situation, a color depth of the emitted red light may be set according to a degree of poorness of the air quality;

if the air quality is good, not adjusting the light source; and finally, allowing the color detection unit to acquire the color information in the environment, and allowing the control unit and the operational unit to determine the control signal according to the color information, so as to control the light source. In this mode, the auxiliary detection unit may be configured to acquire information about the existence of the human body and the air quality information with priority after the smart lighting system is turned on. Subsequently, the color detection unit is adopted to acquire colors in the environment.

Another light-emitting mode may be as follows:

the auxiliary detection unit and the color detection unit acquire the environment information;

when the color detection unit obtains the color information in the environment, determining the control signal according to the color information, and controlling the light source to emit light, e.g., blue light;

when the air quality sensor detects poor air quality, determining the control signal by the superimposition of the auxiliary information and the color information, and controlling the light source to emit light, e.g., flashing the blue light; and when the human body detecting sensor detects the existence of a human body, determining the control signal by the superimposition of the auxiliary information and the color information, and controlling the light source to emit light, e.g., increasing brightness of the blue light.

In this mode, the color detection unit and the auxiliary detection unit are adopted together for detection, and subsequently, the light source is controlled to emit light by the superimposition of the color information and the auxiliary information.

In a specific application, the color detection unit 111 or the environment acquisition module 11 may adopt unfixed arrangement. Moreover, the color detection unit 111 or the environment acquisition module 11 may move along with the human body, so as to ensure the accurate acquisition of the environment information around the human body. Ultimately, the lighting module 12 is adopted to provide needed illumination for the human body, for instance, good illumination around the human body.

With reference to FIG. 2, in a specific application, the number of the lighting modules in the smart lighting system may be multiple, and the control units 121 and the operational units of the plurality of lighting modules 12 determine respective control signals according to the environment information, respectively. Therefore, one environment acquisition module 11 may simultaneously provide the environment information to the plurality of lighting modules 12, so that a plurality of environment acquisition modules are not required to be arranged for the plurality of lighting modules in a certain space, and hence the cost of the smart lighting system can be reduced. For instance, an indoor room may have a plurality of lighting modules, including tube lights disposed around the room and a ceiling lamp disposed in the middle, and one environment acquisition module is adopted to provide environment information for the lighting modules, so that synchronous light control can be achieved. Therefore, the cost of the smart lighting system can be reduced by adoption of one environment acquisition module to provide the environment information for the plurality of lighting modules.

Figure 3:
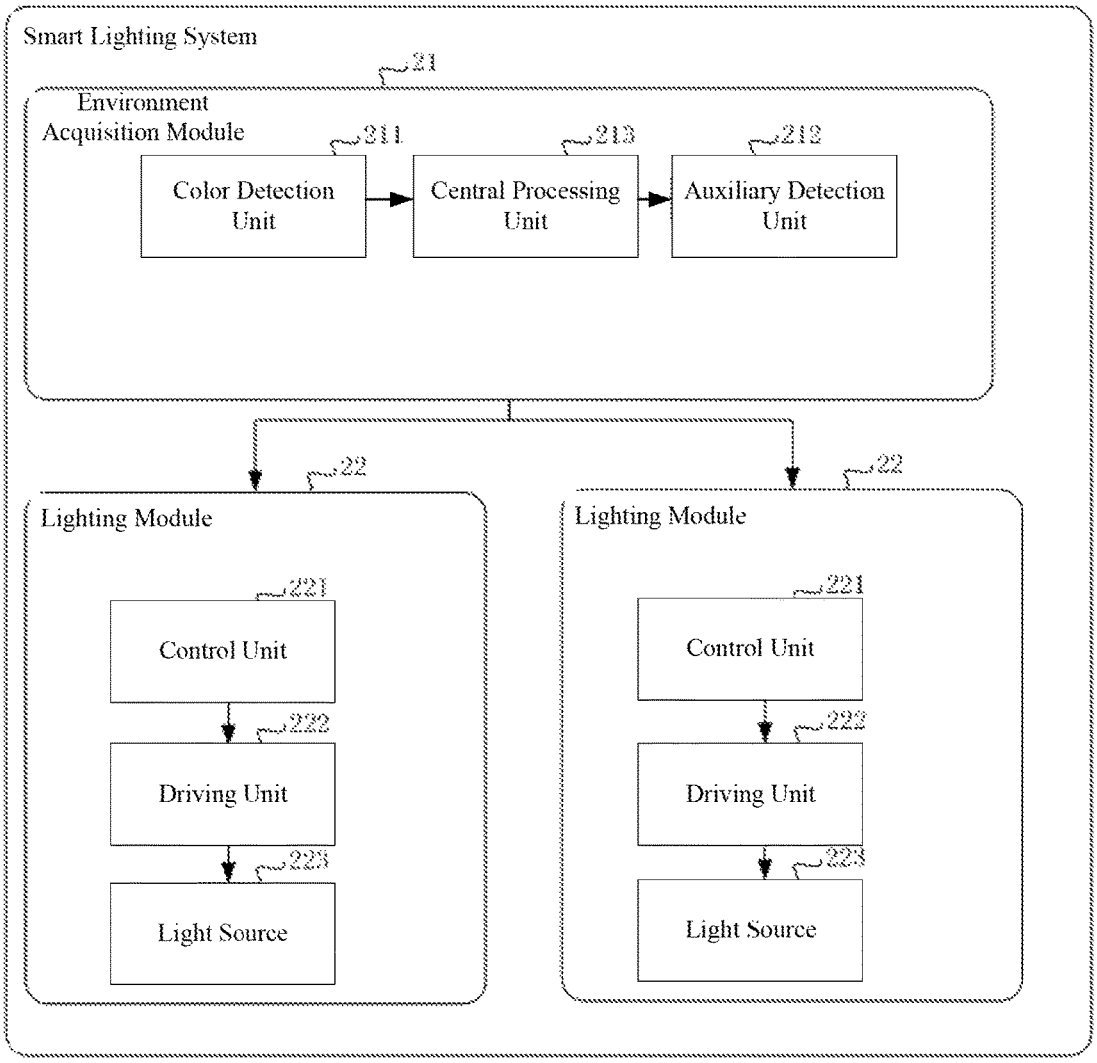
FIG. 3 is a schematic architecture diagram of a smart lighting system provided by a second embodiment of the present disclosure.

FIG. 3 is a schematic architecture diagram of a smart lighting system provided by a second embodiment of the present disclosure.

With reference to FIG. 3, the smart lighting system provided by the second embodiment of the present disclosure may include an environment acquisition module 21 configured to acquire environment information and a plurality of lighting modules 22 used for lighting, wherein the environment acquisition module 21 may include a color detection unit 211 and an auxiliary detection unit 212. Each lighting module 22 may specifically include a control unit 221, a driving unit 222 and at least one light source 223.

The environment acquisition module 21 further includes a central processing unit (CPU) 213, which may be configured to analyze color information and auxiliary information and acquire multiple pieces of environment information that are respectively corresponding to the plurality of lighting modules 22. Correspondingly, the control units 221 and operational units of the plurality of lighting modules 22 determine respective control signals according to corresponding environment information respectively. In a specific use environment, in order to save power, the plurality of lighting modules needs to achieve different controls according to specific environment information. Thus, the CPU 213 is adopted to analyze the color information and the auxiliary information and acquire the multiple pieces of environment information corresponding to the plurality of lighting modules respectively. Moreover, the environment acquisition module 21 transmits the multiple pieces of environment information that are respectively corresponding to the plurality of lighting modules to the lighting modules 22 respectively, and a respective control unit 221 and operational unit of each lighting module 22 determine a respective control signal according to respective environment information, so as to achieve different controls of the plurality of lighting modules. Thus, the energy can be saved while saving the cost of the smart lighting system simultaneously.

A specific application scene—street lights. In an initial state, all the street lights on a road irradiate with a low brightness. When a human body detecting sensor detects that there is a human body on the road and meanwhile a position sensor detects a position of the human body, the CPU analyzes and determines a moving direction of the human body according to the positions of the human body at different times. The CPU processes according to the foregoing detection result and the moving direction of the human body, and acquires multiple pieces of environment information that are corresponding to the street lights respectively; and the environment acquisition module respectively transmits a respective piece of environment information to a corresponding street light for control of the street light. For instance, a street light ahead of the moving direction of the human body outputs light with a high brightness and a street light behind the moving direction of the human body outputs light with a low brightness.

Detailed description is given above to the structure of the smart lighting system provided by the present disclosure. Detailed description will be given below to a control method of the smart lighting system provided by the present disclosure.

Figure 4:
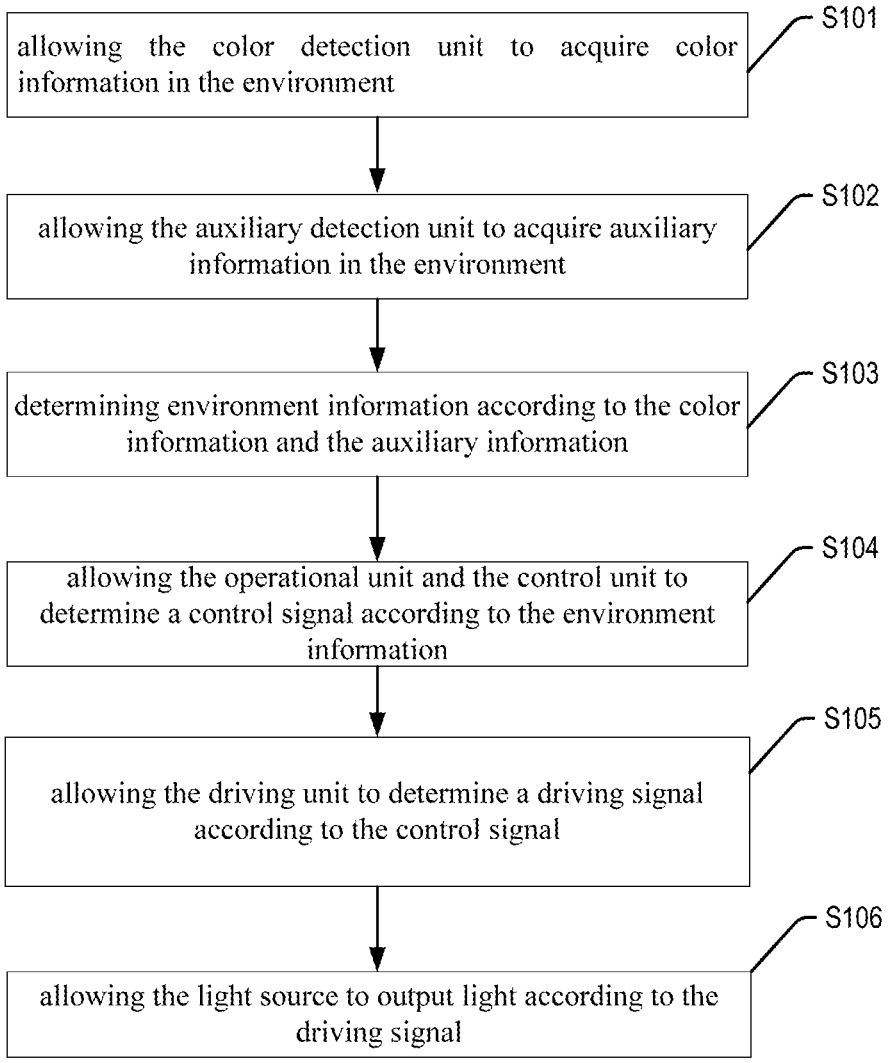
FIG. 4 is a flow diagram of a control method of the smart lighting system provided by the first embodiment of the present disclosure.

FIG. 4 is a flow diagram of a control method of the smart lighting system provided by the first embodiment of the present disclosure.

The control method of the foregoing smart lighting system may specifically include:

S101: allowing the color detection unit to acquire color information in the environment;

S102: allowing the auxiliary detection unit to acquire auxiliary information in the environment;

S103: determining environment information according to the color information and the auxiliary information;

S104: allowing the operational unit and the control unit to determine a control signal according to the environment information;

S105: allowing the driving unit to determine a driving signal according to the control signal; and S106: allowing the light source to output light according to the driving signal.

Moreover, the auxiliary information includes human body existence information and/or air quality information and/or human body position information.

Moreover, the number of the lighting modules is multiple. The control units and the operational units of the plurality of lighting modules respectively determine respective control signals according to the environment information.

Figure 5:
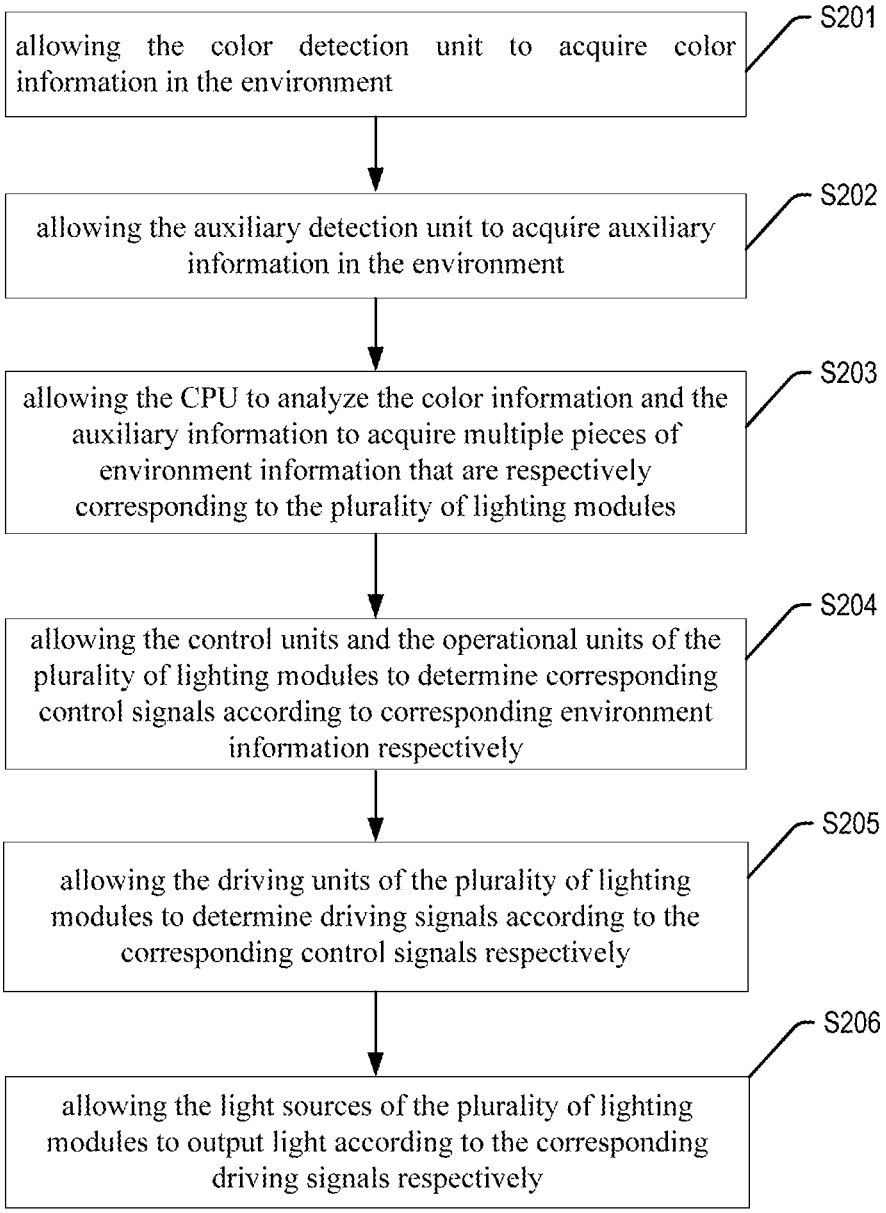
FIG. 5 is a flow diagram of a control method of the smart lighting system provided by the second embodiment of the present disclosure.

FIG. 5 is a flow diagram of a control method of the smart lighting system provided by the second embodiment of the present disclosure.

The control method of the foregoing smart lighting system may specifically include:

S201: allowing the color detection unit to acquire color information in the environment;

S202: allowing the auxiliary detection unit to acquire auxiliary information in the environment;

S203: allowing the CPU to analyze the color information and the auxiliary information to acquire multiple pieces of environment information that are respectively corresponding to the plurality of lighting modules;

S204: allowing the control units and the operational units of the plurality of lighting modules to determine corresponding control signals according to corresponding environment information respectively;

S205: allowing the driving units of the plurality of lighting modules to determine driving signals according to the corresponding control signals respectively; and S206: allowing the light sources of the plurality of lighting modules to output light according to the corresponding driving signals respectively.

Figure 6:
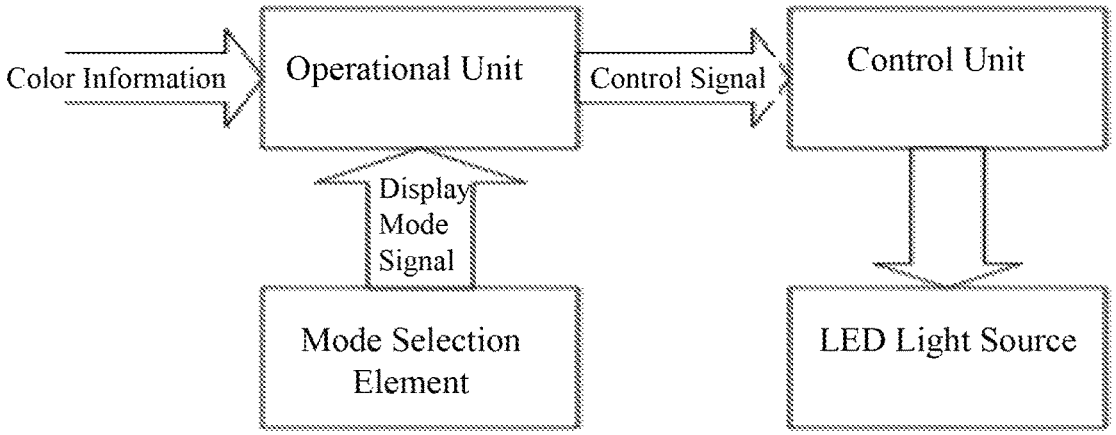
FIG. 6 is a schematic structural view of a smart lighting system comprising an operational unit provided by the present disclosure.

As shown in FIG. 6, FIG. 6 is a schematic structural view of a smart lighting system provided by the present disclosure, in which an environment acquisition module further includes an operational unit. The system includes: a light source, an operational unit and a control unit.

Figure 8:
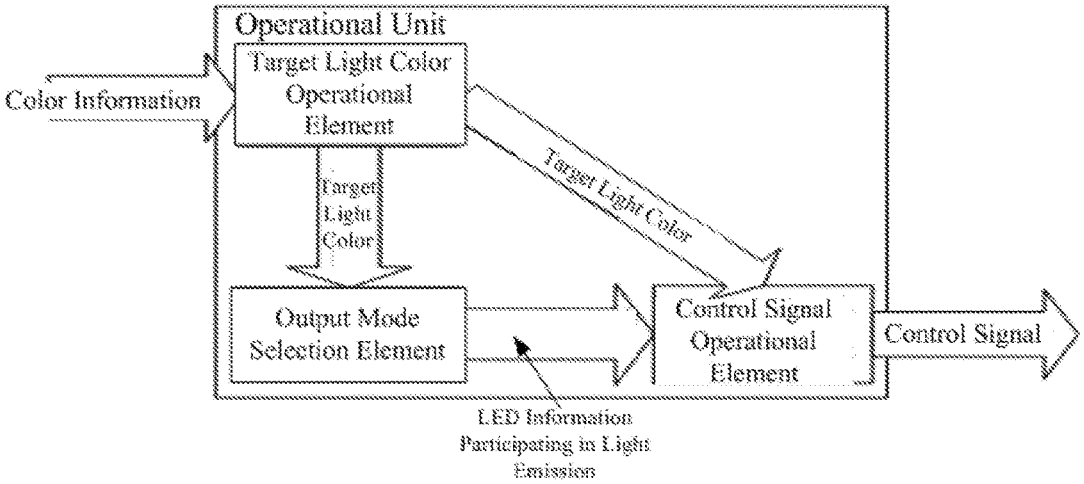
FIG. 8 is a schematic structural view of a first preferred embodiment of the smart lighting system comprising the operational unit provided by the present disclosure.

The operational unit is a core of the system, and a first preferred embodiment of the system is referred to with FIG. 8. The operational unit receives color information from a color detection unit, obtains a target light color by calculation, and calculates a control signal of a light source according to the target light color. The operational unit includes a target light color operational element, an output mode selection element and a control signal operational element. The target light color operational element receives the color information and obtains the target light color according to the color information. The color information here may be in a form of RGB or a form of XYZ, or may be an x value and a y value which may be directly represented in the CIE 1931 chromaticity diagram. The target light color may be the same as the inputted color information, or a complementary color thereof, or an enhanced color. Thus, in the operational processing of the target light color, a relationship between the light color we expect to acquire and the inputted color information is needed to be known, and so, the system further includes a mode selection unit. The mode selection unit provides a display mode signal to the operational unit, which indicates whether the final target light color is the same color, the complementary color or the enhanced color, and the target light color operational element performs corresponding operations according to the signal.

In the embodiment, the inputted color information is provided by the color detection unit. In the embodiment, a color sensor is adopted to detect the color information of an object irradiated by the lighting system. The color sensor may be classified into a RGB color sensor or a XYZ color sensor according to the output difference. In the embodiment, the RGB color sensor is adopted and corresponds to an RGB color model. The RGB color model is a common color model and originates from the trichromatic theory on vision, that is, all the colors in nature may be synthesized by RGB three monocolors. Thus, the color signals outputted by the RGB color sensor are RGB three-color components. The color sensor identifies color by receiving light reflected from an object. However, different positions of the same object may also have different colors. In order to accurately measure the color, in another preferred embodiment, a converging lens element may be disposed on a light incident window of the RGB color sensor. The lens element may be selected from a converging lens such as a convex lens and a Fresnel lens or a combination thereof, so that the RGB color sensor can only receive incident light from a small range. Particularly when the irradiated object is far away, the solution of including the lens element is preferred. When the irradiated object is close, in order to eliminate the interference of ambient light, a measurement-auxiliary light source may be additionally arranged in the color detection unit. The measurement-auxiliary light source does not participate in final lighting and only irradiates the irradiated object in the process of color measurement. Thus, accurate color information may be obtained in the subsequent calculation by directly adjusting operation parameters according to the light color characteristics of the measurement-auxiliary light source. The measurement-auxiliary light source is preferably white light, and the color temperature of the light source may be 2,700K-20,000K. It should be understood that the solution of including the measurement-auxiliary light source may also be selected when the irradiated object is far away. However, due to far distance, even the object is irradiated by the measurement-auxiliary light source, the function of eliminating the interference of the ambient light is also limited.

A specific calculation method of the target light color in the embodiment is as follows and includes three basic steps:

Step A: calculating corresponding X, Y and Z values in a CIE XYZ system according to RGB color signals measured in an RGB color sensor. A conversion formula is as follows:

$$\begin{pmatrix} X \\ Y \\ Z \end{pmatrix} = N_I \begin{pmatrix} R \\ G \\ B \end{pmatrix},$$

where N refers to a 3*3 matrix. As described above, there are color sensors capable of directly outputting XYZ parameters, but the RGB color sensor is preferred in the embodiment. Thus, as for different color detection parts, the parameters in N are adjusted according to different conditions, e.g., whether there is a lens and whether the measurement-auxiliary light source is adopted, so that better effect can be achieved.

Step B: converting the X, Y and Z values into color parameters in the CIE xyY color space, including a brightness Y parameter and a color coordinate x,y. The Y value in the xyY is consistent with a Y stimulus value in XYZ and indicates the color brightness or the light brightness. The color coordinate x,y is used for specifying a color on a two-dimensional diagram, and this type of chromaticity diagram is referred to as CIE 1931 Chromaticity Diagram. For instance, when a coordinate of a point on the chromaticity diagram is x=0.4832 and y=0.3045, the color of the point is matched with the color of a red apple. The specific conversion formula is as follows: x0=X/(X+Y+Z), y0=Y/(X+Y+Z), where x0 and y0 refer to x and y coordinate values of the color signal acquired by the color detection part in the CIE xyY color space.

Step C: calculating target color parameters of the target light color in the CIE xyY color space, with the formula as follows:

$$x_obj = k*(x0 - xb) + xb$$

$$y_obj = k*(y0 - yb) + yb$$

$$z_obj = 1 - x_obj - y_obj$$

where x_obj, y_obj and z_obj respectively represent x, y and z coordinate values of the target light color in the CIE xyY color space. The variable k is determined according to the display mode signal provided by the mode selection module. Thus, in the step C, a value may be assigned to the variable k according to the display mode signal; if the target color is the same color, k=1; and if the target color is the complementary color, k=−1. In the case of complementary color, the point (x0, y0) represented by the measured color in the CIE 1931 chromaticity diagram and the point (x_obj, y_obj) represented by the target color are points that are symmetrical with respect to equal-energy white light, and so, xb and yb represent a point indicating the equal-energy white light in the CIE xyY color space, xb=yb=0.33.

The target light color finally calculated and acquired by the target light color operational element is the x and y values capable of being indicated in the CIE 1931 chromaticity diagram, and the outputted target light color is the point (x_obj, y_obj) in the CIE 1931 chromaticity diagram.

The light source is an output part of the lighting control system provided by the embodiment and includes L groups of luminescent units with different colors, and L≥3. The luminescent units may be selected from TL lamps, halogen lamps, LEDs, etc. In the embodiment, the LEDs are taken as the light source. The luminescent units are generally selected to include one group of red LEDs, one group of blue LEDs and one group of green LEDs, and visible light of any color may be mixed by the three colors. In order to mix different light colors, it's needed to select LEDs with a plurality of different colors. Thus, at least three kinds of LEDs are needed. Of course, more light colors may be synthesized by the addition of LEDs of other colors. Therefore, LEDs of a fourth color and LEDs of a fifth color may be added; for instance, amber LEDs are added into the RGB LEDs. Different LED combinations may also be selected according to different display colors; for instance, amber LEDs are adopted to replace the red LEDs. In the embodiment, four groups of LEDs are selected, and one group of white light is added, so that the light color obtained by light mixing can be richer and more natural. The four groups of luminescent units are respectively: white LEDs, in which white light is obtained by adoption of blue light to excite fluorescent powder, and the color temperature is 2,300K-6,500K; red LEDs with a peak wavelength of 600-660 nm; green LEDs with a peak wavelength of 510-550 nm; and blue LEDs with a peak wavelength of 430-480 nm. Each group of LEDs may only include a single luminescent unit, or may include a plurality of luminescent units of the same model which are combined into one group. The LEDs in the present disclosure may refer to packaged LEDs, unpackaged LEDs, surface mount LEDs, chip on board (COB) LEDs or LEDs with an optical element of a certain type.

Figure 7:
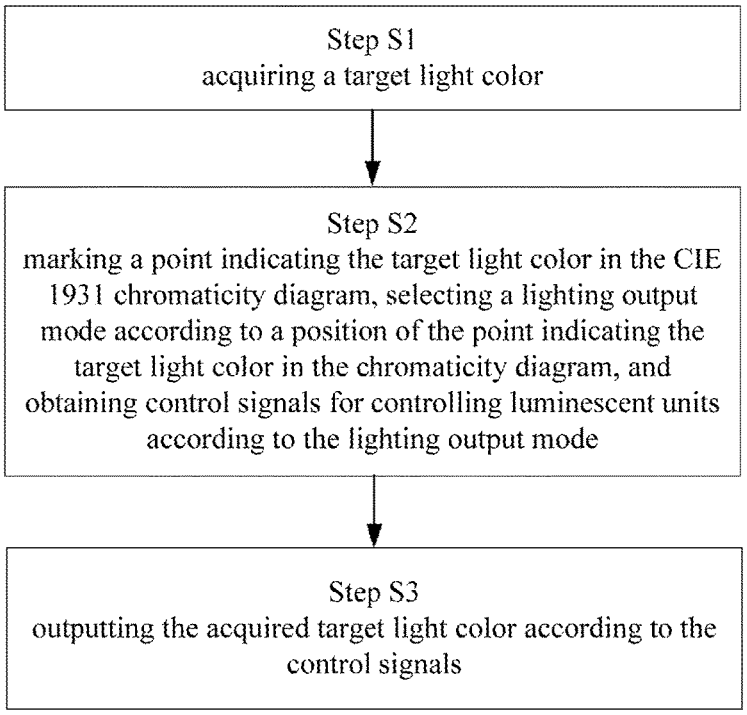
FIG. 7 is a flow diagram of a smart lighting method comprising an operational unit provided by the present disclosure.

As the target light color acquired by the target light color operational element is formed by the mixing of light emitted by the groups of luminescent units, in order to produce light with different colors, an intensity of the light emitted by each group of luminescent units may be adjusted according to the target light color. The operational module finally outputs control signals for controlling the light intensity of the groups of luminescent units, and the control signals are PWM signals or current values. In the embodiment, for the operational module to obtain the control signals, the output mode selection element and the control signal operational element may be adopted for the operational processing of the target light color. A specific operational method is as shown in FIG. 7:

Step S1: acquiring a target light color.

Step S2: marking a point indicating the target light color in the CIE 1931 chromaticity diagram, selecting a lighting output mode according to a position of the point indicating the target light color in the chromaticity diagram, and obtaining control signals for controlling luminescent units according to the lighting output mode.

Step S3: outputting the acquired target light color according to the control signals.

A specific method of the step S2 is that: light colors emitted by the luminescent units in the system are marked in the CIE 1931 chromaticity diagram; the light color of each group of luminescent units is represented by a light source luminous point; an output light color area is encircled by taking I (L≥I≥3) light source luminous points as vertexes; a point indicating the target light color falls into the output light color area; and luminescent units represented by the vertexes of the output light color area are luminescent units which needs to participate to emit light and display the target light color. This step is completed by the output mode selection element. The output mode selection element reads the target light color, acquires information of the luminescent units participating to emit light by the above method, and outputs the information to the control signal operational element. The control signal operational element calculates the control signals for controlling the luminescent units according to the information of the luminescent units participating to emit light and the target light color from the target light color operational element. In the embodiment, each emission of light adopts the mixed emission of 3 groups of luminescent units, so that the energy can be maximally saved. Thus, I=3, and the control signals for the groups of luminescent units participating to emit light are respectively C_l1, C_l2 and C_l3, which may be specifically acquired by operation according to the following formula:

$$\begin{pmatrix} C \ldots l1 \\ C \ldots l2 \\ C \ldots l3 \end{pmatrix} = M1 \times \begin{pmatrix} x \ldots obj \\ y \ldots obj \\ z \ldots obj \end{pmatrix},$$

where M refers to a 3*3 matrix, and x_obj, y_obj and z_obj refer to coordinate values of the point indicating the target light color in the chromaticity diagram. The control signal operational element transmits the control signals to the control units after acquiring the control signals; the control units control the luminous intensities of the groups of luminescent units according to the control signals respectively; and the light source generates the target light color by the combination of the luminous intensities. In order to light up the LEDs, a driving power needs to be provided. The control units may be arranged together with the driving power, or the driving power may be disposed in a lamp body and connected with the light source.

The components in the system may be integrally arranged and may also be separately arranged. In the embodiment, the operational unit and the color detection unit form a handheld device. The control unit and the LED light source form a lamp and transmit the control signals through wireless signals. In other preferred embodiments, the components may also be all separately arranged as required, or a plurality of components are assembled together, and separated components may communicate with each other through wired or wireless signals. The wireless communication approach may be WIFI, ZigBee or Bluetooth.

Further description will be given below to the first preferred embodiment by taking a specific color as an example.

The color signal here is from an external color detection device. The color detection unit includes an auxiliary lighting source. The auxiliary lighting source is a 6,500K white-light LED, with the power of 0.2 W and a luminous flux of 25 lm. When a red object is placed at 1 cm in front of a sensor, the RGB reading of the sensor is (703,341,302). The color parameter XYZ is calculated according to the formula in the step A, which is described in detail as follows.

Subsequently, a corresponding coordinate position of XYZ on the CIE xyY chromaticity diagram is calculated, namely x0=703/(703+341+301)=0.5090, y0=341/(703+341+301)=0.3902.

Finally, the target light color is calculated. In the embodiment, a goal is that the color outputted by a lighting device is the same as the color of the object, so k=1. The position of the final target light color on the chromaticity diagram is as follows: x_obj=x0=0.5090, y_obj=y0=0.3902, as shown in FIG. 4.

Figure 9:
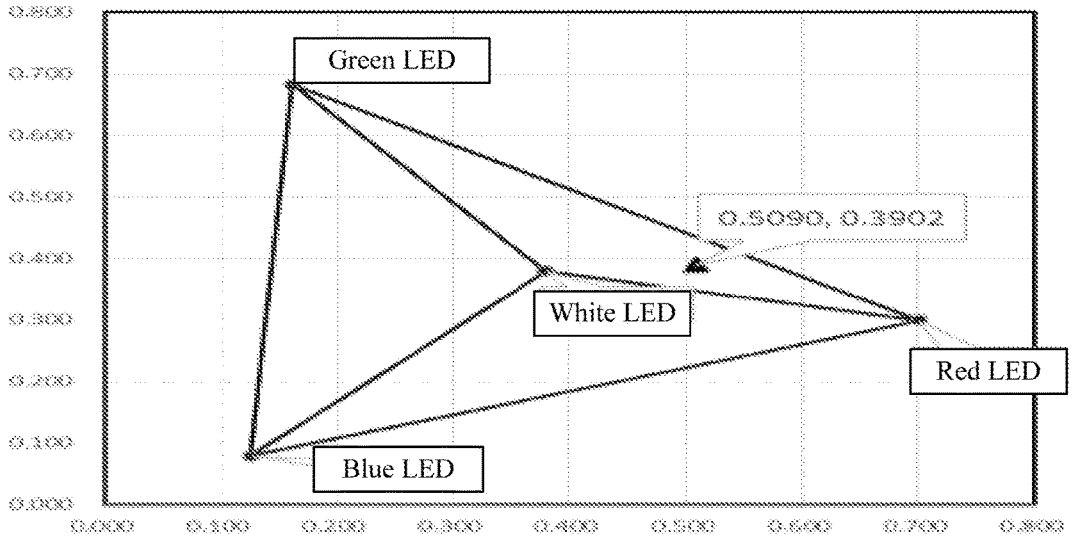
FIG. 9 is a light color diagram of FIG. 8.

In the example, as four groups of LEDs are adopted, ten 3,000K white, ten red (635 nm) LEDs, ten green (525 nm) LEDs and ten blue (460 nm) LEDs respectively, with the model of 2835 and the power of 0.5 W. Light colors emitted by the groups of LEDs are marked on the chromaticity diagram as shown in FIG. 9; I points are selected from these points and taken as vertexes to encircle an output light color area; the point (x_obj, y_obj) is encircled within the output light color area. I shall be greater than or equal to 3, otherwise, one area cannot be formed; and the maximum of I shall be equal to the number of the luminescent units in the lighting system, as it is impossible to have the number of vertexes to be greater than the number of the luminescent units. In the embodiment, in view of energy saving, I=3 is selected. As it can be seen from FIG. 9, the output light color area may be formed to include the point indicating the target light color by selection of white light, green light and red light or selection of blue light, green light and red light. Here, a point close to the target light color is generally selected as a vertex, and white light is so in this example, so that white light, green light and red light are finally selected here to participate to emit light. That is, the finally outputted light is obtained by the mixing of the white, red and green LEDs. Specific control signals of the LEDs of various colors are obtained by calculation according to the following formula, wherein PWM_3K is C_l1 in the step D and represents a PWM signal of the white LED, PWM Red is C_l2 in the step D and represents a PWM signal of the red LED, and PWM_Green is C_l3 in the step D and represents a PWM signal of the green LED. Finally, the control units control the white, red and green LEDs to emit light according to the PWM signals, and a pink light is obtained after the light mixing.

In the embodiment, although the pink light that is capable of displaying the target light color is obtained, whether the light has an optimum effect needs to be further verified. Thus, an iteration step is also added here. The iteration step is executed after the light source emits the target light color. In the embodiment, after the white, red and green LEDs emit the pink light after light mixing according to the control signals, the color detection unit obtains a color signal of an irradiated object irradiated by the pink light again, compares the color signal with a previously acquired color signal, determines whether the color signal is optimum. If so, the current light color is maintained; and if not, the steps A to D are executed by inputting the color information of the current irradiated object. Accordingly, a new target light color and control signal are obtained. Then, the color detection unit obtains a color signal of the irradiated object irradiated by the current light color again, and compares the color signal with the previous color signal. This process is iterated until the comparison result is optimum. The determination of whether the light color is optimum is to compare the color difference of color signals of the irradiated object acquired by the color detection unit in two adjacent times, which is difference of two points in the CIE xyY color space converted from the color signals. The light color is considered to be optimum when the color difference of the two times is less than or equal to a certain value. A method to calculate the difference value is Duv=sqrt((u2−u1)^2+(v2−v1)^2). In the example, the difference value Duv is required to be less than or equal to 0.001, where (u1,v1) and (u2,v2) are respectively chromaticity coordinate values of color information obtained by the color detection unit in the adjacent two times.

Figure 10:
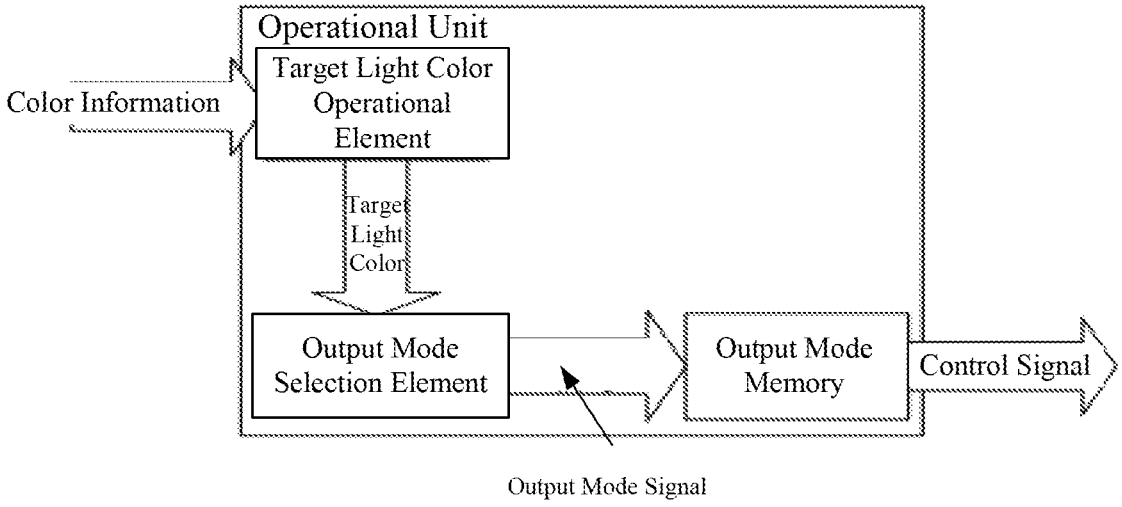
FIG. 10 is a schematic structural view of a second preferred embodiment of the smart lighting system comprising the operational unit provided by the present disclosure.

In the embodiment, by the calculation of the control signals each time, although the color displayed by the lighting system may be rich and varied, the lighting produced by such light mixing cannot ensure its color rendering, brightness, etc. Moreover, we may not need so many display colors. Therefore, on the basis of the basic concept of the present disclosure, another solution is provided. Further description is given here to a solution with reference to a second preferred embodiment. The system of the second preferred embodiment is similar to that of the first preferred embodiment. The schematic structural view of the system is as shown in FIG. 10, and the basic method is as shown in FIG. 7, which will not be further described here. A main difference from the first preferred embodiment is the difference of the operational unit. The schematic structural view of the operational unit of the system is as shown in FIG. 10. The operational unit includes a target light color operational element, a mode selection module and an output mode memory. The target light color operational element is the same with that in the first preferred embodiment, but the mode selection module adopts different operation modes. A specific method of the mode selection module includes: dividing a plurality of areas in the CIE 1931 chromaticity diagram; presetting an output mode for each area; presetting corresponding luminescent units participating to emit light and control signals of the luminescent units for each output mode; and pre-storing these parameters of the luminescent units corresponding to each output mode in the output mode memory. The mode selection module determines an output mode according to an area of the output mode where the point indicating the target light color falls in, and outputs the acquired output mode signal to the output mode memory, and the output mode memory reads the control signals corresponding to the output mode signal and outputs the control signals to a controller.

Figure 11:
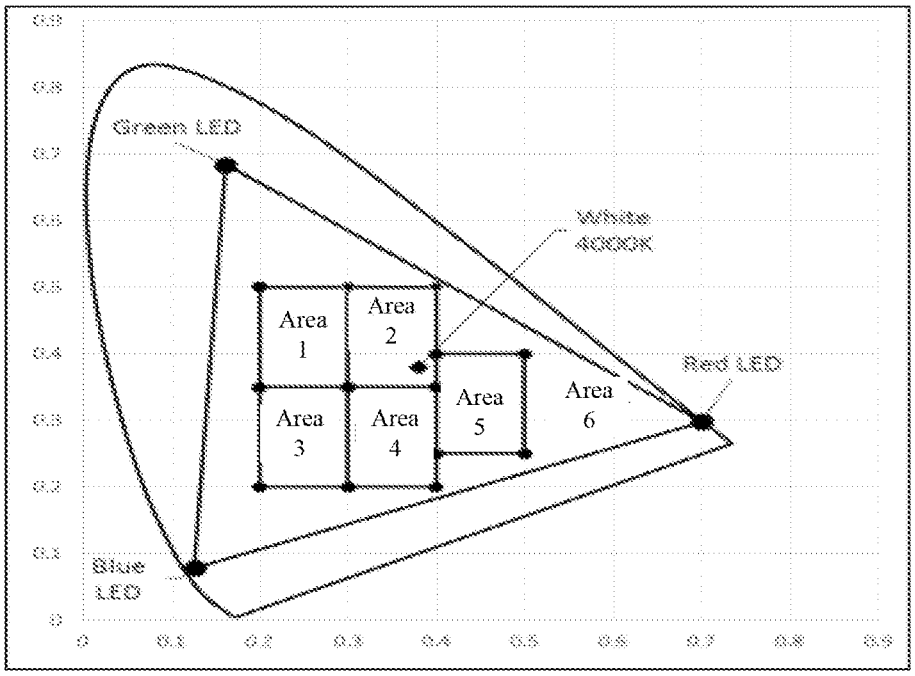
FIG. 11 is a light color diagram of FIG. 10.

As shown in FIG. 11, the luminescent units in the embodiment are selected as ten 4,000K white, ten red (635 nm), ten green (525 nm) and ten blue (460 nm) LEDs respectively, with the model of 2835, the power of 0.5 W for the white light, and the power of 0.4 W for monochromatic light. The points are marked in FIG. 6, and areas 1 to 6, 6 areas in total, are divided according to realizable light colors, wherein the area 6 is an area provided with all the other displayable colors except the areas 1 to 5, that is, a remaining area obtained by removing the areas 1 to 5 from an area encircled by the RGB three-color LEDs. The areas 1 to 6 respectively correspond to the modes 1 to 6. The control signals of each mode is shown in the following table:

| 区域 | PWM_4000K | PWM_Red | PWM_Green | PWM_Blue |
|---|---|---|---|---|
| 1 | 60% | 10% | 40% | 20% |
| 2 | 80% | 40% | 30% | 15% |
| 3 | 60% | 10% | 20% | 30% |
| 4 | 80% | 40% | 10% | 40% |
| 5 | 75% | 80% | 20% | 15% |
| 6 | 100% | 0% | 0% | 0% |

Data in the table are stored in the output mode memory.

When the inputted color information is x_obj=0.2497, y_obj=0.4669 and z_obj=0.2833, the target light color falls into the area 1 as shown in FIG. 10. Thus, the mode selection module determines the output mode to be the mode 1 and outputs the acquired output mode signal to the output mode memory. The output mode memory reads the control signals corresponding to the output mode signal, that is, the first row of data in the above table, and outputs the control signals to the controller. The output color parameters acquired according to the control signals are shown in the following table:

| x | y | CCT | R9 | CRI | CQS | CAI | MCRI | Flux (lm) |
|---|---|---|---|---|---|---|---|---|
| 0.3574 | 0.3881 | 4726 | 48.5 | 87.8 | 90.2 | 103.2 | 92.1 | 850 |

Figure 12:
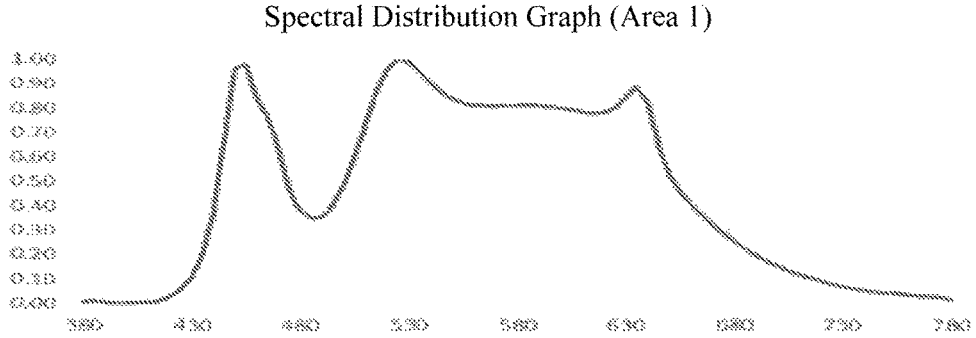
FIG. 12 is a spectral distribution graph of FIG. 10.

A spectral distribution graph of the output light is as shown in FIG. 12

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "unit," or "sub-unit" may include memory (shared, dedicated, or group) that stores code or instructions that can be executed by one or more processors. Sometimes, terms "module," "sub-module," "unit," or "sub-unit" may refer to a circuitry or a circuit that may be designed to perform certain functions provided in the present disclosure.

The foregoing is only the embodiments of the present disclosure and is not intended to limit the present disclosure. Various modifications and changes may be made to the present disclosure by those skilled in the art. Any modification, equivalent replacement, improvement or the like made within the spirit and the principle of the present disclosure shall fall within the scope of protection of the appended claims.

What is claimed is:

1. A smart lighting system, comprising: an environment acquisition module being configured to acquire environment information and at least one lighting module, and wherein the environment acquisition module comprises:

a color detection unit configured to acquire color information in an environment;

an auxiliary detection unit configured to acquire auxiliary information in the environment, wherein the environment information is determined by using the color information and/or the auxiliary information;

an operational unit and a control unit configured to determine a control signal according to the environment information; and wherein the at least one lighting module comprises:

a driving unit configured to determine a driving signal according to the control signal; and at least one light source configured to receive the driving signal and emit light according to the driving signal.

2. The smart lighting system according to claim 1, wherein the auxiliary detection unit comprises at least one of a human body detecting sensor, an air quality sensor or a position sensor.

3. The smart lighting system according to claim 1, wherein the color detection unit and the lighting module are separately arranged.

4. The smart lighting system according to claim 1, wherein the color detection unit is close to or fixed on an irradiated operating surface.

5. The smart lighting system according to claim 1, wherein the environment acquisition module and the lighting module are integrally arranged; or the color detection unit is separately arranged with the lighting module and also separately arranged with the auxiliary detection unit, and the lighting module and the auxiliary detection unit are integrally arranged; or the color detection unit is separately arranged with the lighting module and also separately arranged with the auxiliary detection unit, and the lighting module and the auxiliary detection unit are separately arranged.

6. The smart lighting system according to claim 1, wherein the environment acquisition module communicates with the lighting module by a wired or wireless approach.

7. The smart lighting system according to claim 1, wherein the light source comprises L groups of luminescent units with different colors, and $L \geq 3$;

the operational unit is disposed in the environment acquisition module or the lighting module that is configured to receive the color information, acquire a target light color according to the color information, and operate to obtain information describing which groups of the luminescent units are participated to emit light and control signals of the luminescent units participating to emit light according to the target light color; and the control unit is disposed in the lighting module that is configured to receive the control signals, control luminous intensities of the groups of the luminescent units according to the control signals, and allow the light source to generate the target light color by the combination of the luminous intensities.

8. The smart lighting system according to claim 7, wherein a quantity of the at least one lighting module is multiple; and the operational unit and the control unit determine respective control signals according to the environment information.

9. The smart lighting system according to claim 8, wherein the environment acquisition module further comprises a central processing unit (CPU) which is configured to analyze the color information and the auxiliary information and acquire multiple pieces of the environment information that are respectively corresponding to the multiple lighting modules; and correspondingly, the operational unit and the control unit determine respective control signals according to the corresponding environment information.

10. The smart lighting system according to claim 7, wherein the operational unit comprises a target light color operational element which is configured to receive the color information and acquire the target light color according to the color information.

11. The smart lighting system according to claim 10, wherein the operational unit further comprises an output mode selection element and a control signal operational element; wherein the output mode selection element is configured to operate to acquire information of the luminescent units participating to emit light according to the target light color, and groups of the luminescent units are participated to emit light; and wherein the control signal operational element is configured to operate to acquire control signals of the luminescent units participating to emit light according to the information of the luminescent units participating to emit light and the target light color.

12. The smart lighting system according to claim 10, wherein the operational unit further comprises an output mode selection element and an output mode memory; wherein the output mode selection element is configured to operate to acquire output mode information according to the target light color; and wherein the output mode memory is configured to output the control signals of the luminescent units that are corresponding to the output mode information according to the output mode information.

13. A control method for a smart lighting system comprising an environment acquisition module being configured to acquire environment information and at least one lighting module, comprising:

allowing a color detection unit to acquire color information in an environment;

allowing an auxiliary detection unit to acquire auxiliary information in the environment;

determining the environment information according to the color information and the auxiliary information;

allowing an operational unit and a control unit to determine a control signal according to the environment information;

allowing a driving unit to determine a driving signal according to the control signal; and allowing a light source to emit light according to the driving signal.

14. The control method according to claim 13, wherein the auxiliary information comprises human body existence information and/or air quality information and/or human body position information.

15. The control method according to claim 13, wherein a quantity of the lighting modules is multiple, and allowing the driving unit to determine the driving signal according to the control signal comprises: allowing the operational unit and the control unit to determine respective control signals according to the environment information.

16. The control method according to claim 15, wherein the environment acquisition module further comprises a CPU, and determining the environment information according to the color information and the auxiliary information comprises:

allowing the CPU to analyze the color information and the auxiliary information and acquire multiple pieces of environment information that are respectively corresponding to the multiple lighting modules; and correspondingly, allowing the operational unit and the control unit to determine respective control signals according to the environment information comprises:

allowing the operational unit and the control unit to determine the respective control signals according to corresponding environment information.

17. The control method according to claim 16, further comprising:

acquiring a target light color;

marking a point indicating the target light color in a CIE 1931 chromatic diagram, selecting a lighting output mode according to a position of the point indicating the target light color in the chromatic diagram, and obtaining control signals for controlling luminescent units according to the lighting output mode; and outputting the acquired target light color according to the control signals.

18. The control method according to claim 17, wherein marking the point comprise:

marking light colors of the luminescent units in the smart lighting system in the CIE 1931 chromatic diagram, with a corresponding light color of each group of the luminescent units being represented as a light source luminous point;

encircling an output light color area by taking I (L≥I≥3) light source luminous points as vertexes, with the point indicating the target light color falling into the output light color area; and representing the luminescent units by the vertexes of the output light color area wherein the luminescent units participate to emit light and display the target light color.

19. The control method according to claim 18, wherein I=3, and after the luminescent units participating to emit light are determined, the control signals for the groups of the luminescent units participating to emit light are obtained by the following formula:

$$\begin{pmatrix} C \ldots l1 \\ C \ldots l2 \\ C \ldots l3 \end{pmatrix} = M1 \times \begin{pmatrix} x \ldots obj \\ y \ldots obj \\ z \ldots obj \end{pmatrix},$$

where M refers to a 3*3 matrix, x_obj, y_obj and z_obj are coordinate values of the point indicating the target light color in the chromatic diagram; and C_l1, C_l2 and C_l3 refer to the control signals of the luminescent units.

20. The control method according to claim 17, wherein marking the point comprises:

dividing a plurality of areas in the CIE 1931 chromatic diagram;

presetting a corresponding output mode for each area;

corresponding each output mode to corresponding luminescent units participating to emit light and control signals of the corresponding luminescent units; and outputting control signals according to an output mode corresponding to a particular area when the point indicating the target light color falls into the particular area.

* * * * *